United States Patent [19]

Repa

[11] Patent Number: 4,499,684

[45] Date of Patent: Feb. 19, 1985

[54] TRIGGER MECHANISM

[75] Inventor: Otto Repa, Oberndorf, Fed. Rep. of Germany

[73] Assignee: Mauser-Werke Oberndorf GmbH, Fed. Rep. of Germany

[21] Appl. No.: 587,186

[22] Filed: Mar. 7, 1984

Related U.S. Application Data

[63] Continuation-in-part of Ser. No. 302,467, Sep. 15, 1981, abandoned, which is a continuation-in-part of Ser. No. 53,803, Jul. 2, 1979, abandoned.

[30] Foreign Application Priority Data

Jul. 12, 1978 [DE] Fed. Rep. of Germany ... 7820914[U]

[51] Int. Cl.[3] ..... F41C 19/02; F41C 17/08

[52] U.S. Cl. ..... 42/69 A

[58] Field of Search ..... 42/69 R, 69 A, 69 B

[56] References Cited

U.S. PATENT DOCUMENTS 1,215,181 2/1917 Newton ..... 42/69 A 2,935,808 5/1960 Woodring et al. ..... 42/69 A 3,183,616 5/1965 Gandy ..... 42/69 A

FOREIGN PATENT DOCUMENTS 119644 9/1947 Sweden ..... 42/69 A

*Primary Examiner*—Richard E. Schafer

*Assistant Examiner*—Ted L. Parr

*Attorney, Agent, or Firm*—McGlew and Tuttle

[57] ABSTRACT

A firearm, particularly a sporting gun, having a rotatable bolt with a locking head and being equipped with a trigger mechanism accommodated in a trigger housing is disclosed. An angled reset member is engaged by the rotatable bolt through a pressure pin, in order to transform the rotary motion into a linear motion. For this purpose, the pressure pin is connected to the reset member, cooperates with a locking projection of the bolt. Upon turning the bolt, the reset member is caused to butt against a contact surface of the pivotally mounted first trigger which is connected to a pivotally mounted hair trigger. The hair trigger is thus pivotable to a safety position.

4 Claims, 2 Drawing Figures

TRIGGER MECHANISM

This is a continuation-in-part of U.S. patent application Ser. No. 302,467 filed Sept. 15, 1981, which was a continuation-in-part of U.S. patent application Ser. No. 53,803 filed July 2, 1979, both now abandoned in favor of this application.

FIELD AND BACKGROUND OF THE INVENTION

This invention relates in general to firearms and in particular to a new and useful trigger mechanism for firearms which includes means for activating a first trigger so as to move a hair trigger from a safety position to a set position.

As is well known, gun trigger mechanism serve the purpose of releasing the cocked lock. As a rule, upon actuating the trigger, a sear operatively connected thereto is lifted until the hammer notch is disengaged and the hammer (striker, firing pin) performs its function under the force of a spring.

Depending on the employed ammunition, the sensitivity of the trigger is of particular importance, for example if bullets are used. In such a case, too heavy trigger pulls are undesirable since they may easily misalign the weapon and spoil the aim. On the other hand, for example with multi-barrel guns, the trigger pull must not be too light, to avoid a doubling, that is, an undesirable or unintentional release of another, second striker.

With triggers for bullet firing, it is known to make a trigger more sensitive by providing a set trigger action. Such a mechanism makes it possible, upon setting the sear in advance, a disengage the sear point from the corresponding notch already by a slight actuation of a hair trigger. Only in hunting guns too finely adjusted hair triggers are undesirable, since the conditions in big game bullet shooting are quite different from those at the target range.

The hair trigger should be set only after the gun is aligned and aimed at the target, ready for firing. At least with regard to possible accidents during the hunt, carrying of a gun with a set hair trigger is to be avoided. If the gun, having the hair trigger already set, is not fired, the trigger must be reset again. In automatically setting guns, the hair trigger is reset only after the gun is set at safe, in cocked bolt-action guns by simultaneously lifting and releasing the hammer.

These mentioned possibilities already show that while using different weapons, the shooter must continually be mindful of which mechanism he is handling in order to avoid accidents or if only to prevent an accidental discharge of the weapon. In this respect, the invention offers a solution and is directed to a setting and releasing mechanism ensuring a completely safe setting during the opening of the bolt, without the necessity of actuating the safety.

SUMMARY OF THE INVENTION

In accordance with the invention there is provided a trigger mechanism which is particularly adaptable for sporting firearms and which includes a bolt and a set trigger action accommodated in a trigger housing. The housing also accommodates mechanical parts for releasing and setting the trigger. In accordance with the invention, the trigger is set by the rotation of the bolt. A projection on the bolt contacts a movable member to thereby displace a first trigger member which in turn causes the setting of a hair trigger. The hair trigger is mounted in the housing for movement between a safety position to a set position.

The invention offers several advantages: the construction and operation of the inventive setting and releasing mechanism are relatively simple and extremely reliable in service. Both the simplicity of the construction and reliability in operation are insured already by the fact that, in practice, a single angle part is needed as the setting member. In addition, the already provided locking projection on the bolt is ingeniously utilized as a cam-like element for controlling the angle part operating as a setting means.

A particular further advantage of the invention is that it may by applied to any conventional kind of setting, for example, to the French hair trigger (rear trigger), to the German hair trigger, and generally to all other constructions of set triggers where, to set the hair trigger, the other trigger performs a pivotal motion.

Thus, in accordance with the invention, in a firearm, particularly a sporting firearm, of the type having a rotatable bolt with a rotary chamber lock and a trigger mechanism of the type having a trigger housing, a first trigger pivotally mounted in the housing, means for mechanically releasing the first trigger, and a hair trigger mounted in the trigger housing for movement between a safety position and a set position responsive to the pivotal movement of the first trigger, there is provided the combination including a locking projection on the bolt for rotation therewith, a setting member mounted in the trigger housing for linear movement, the locking projection being engageable with the setting member during the rotation of the bolt to actuate the linear movement of the setting member in one direction, and the first trigger being pivotally actuated by the movement of the setting member in the one direction, thereby setting the hair trigger.

Accordingly, it is an object of the invention to provide a trigger mechanism which includes a first trigger which is displaced by the rotation of a rotatable bolt and this displacement causes the movement of a hair trigger into a set position.

A further object of the invention is to provide a trigger mechanism which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
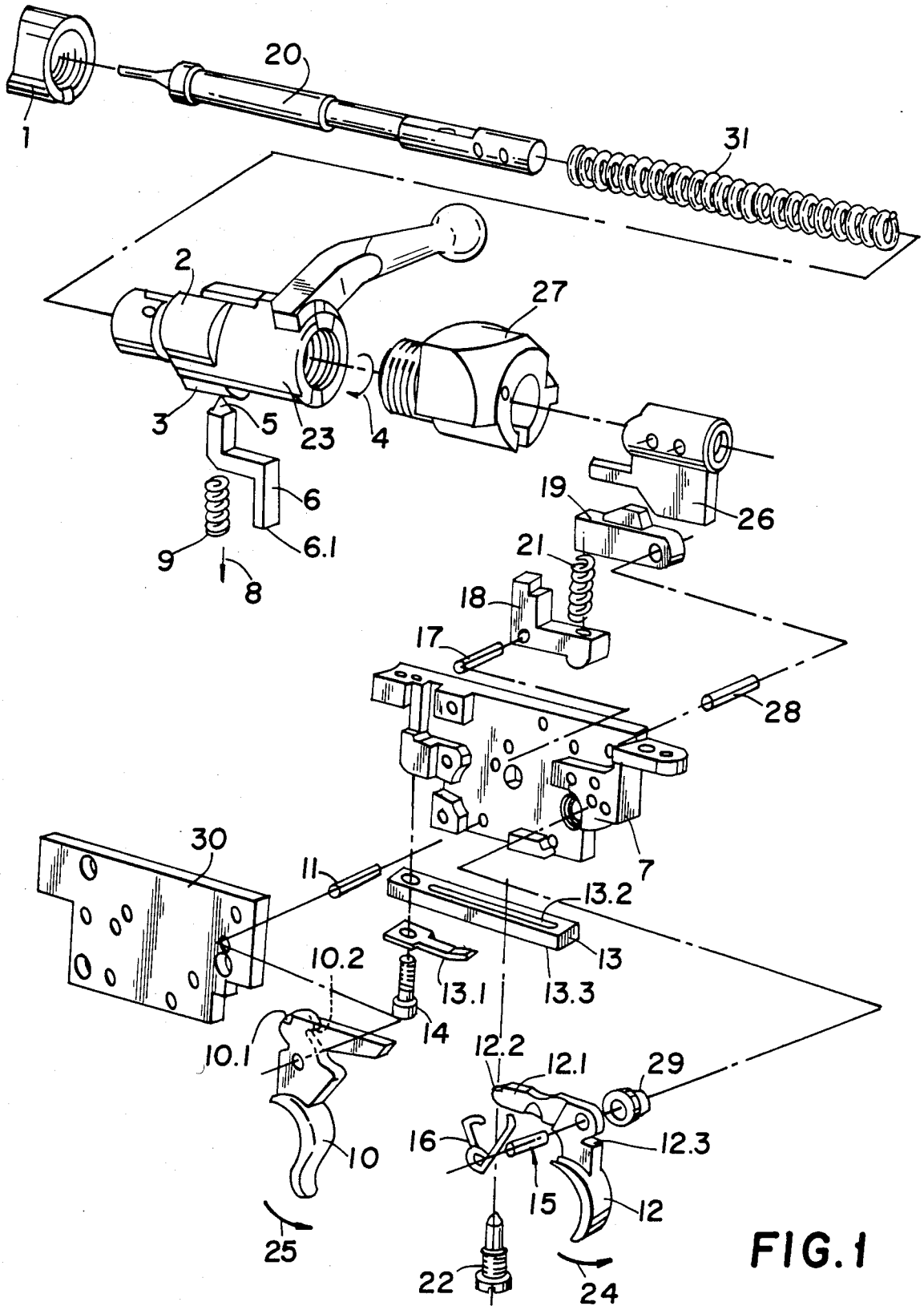
FIG. 1 is an exploded perspective view of the inventive trigger and reset mechanism in a German-type hair trigger construction.

A bolt 1 of a sporting gun (not shown) is provided with locking projections 2 and 3 on its outer surface. As the locking head 23 is opened, bolt 1 executes a rotary motion in the direction of arrow 4. Locking projection 3 which is designed as a sort of cam, therefore runs against a pressure pin 5. Pin 5 is connected to an angle-shaped reset member 6 which is accommodated in a trigger housing 7. The rotary motion of bolt 1 is thus transformed through locking projection 3 and pressure pin 5 to reset member 6 and transformed into a linear motion thereof, as indicated by arrows 8. A helical compression spring 9 is provided between reset member 6 and the respective portion of the trigger housing 7 in which member 6 is guided. Spring 9 resiliently urges member 6 into operative contact with locking projection 3. A lower edge 6.1 of reset member 6 cooperates, by engagement, with a correspondingly shaped edge 10.1 of trigger 10 which is mounted for pivoting about a pivot pin 11. The contact area between edges 6.1 and 10.1 is located ahead of the pivot axis of pivot pin 11.

The hair or set trigger 12 is also mounted to trigger housing 7. Hair trigger 12 is shaped to sit in the slot of a hair trigger leaf spring or arm 13. A screw 14 fixes one end of spring 13 to housing 7. Hair trigger 12 is pivotally mounted on a pivot pin 15 which simultaneously serves as a support for a hair trigger return spring 16. A sear lever 18 is pivotally mounted on a pivot pin 17, for cooperation with hair trigger 12. A pivotal motion of sear lever 18, which is caused by hair trigger 12 upon disengagement of hair trigger arm or spring 13, enables sear 19 to swing downwardly, so that firing pin nut 26 and firing pin 20 in locking head 23 are released. A helical compression spring 21 is inserted between sear lever 18 and sear 19. A set screw 22 is provided below hair trigger 12, for purposes of adjustment. Screw 22 engages the trigger 12 and not the spring 13.

Firing pin 20 is loaded by a firing pin spring 31 received in bolt 1. A lock 27 is screwed to the rear of lock head 23 and in turn has a firing pin nut secured to its rear end. Sear 19 is pivoted to housing 7 through a pivot pin 28.

Figure 2:
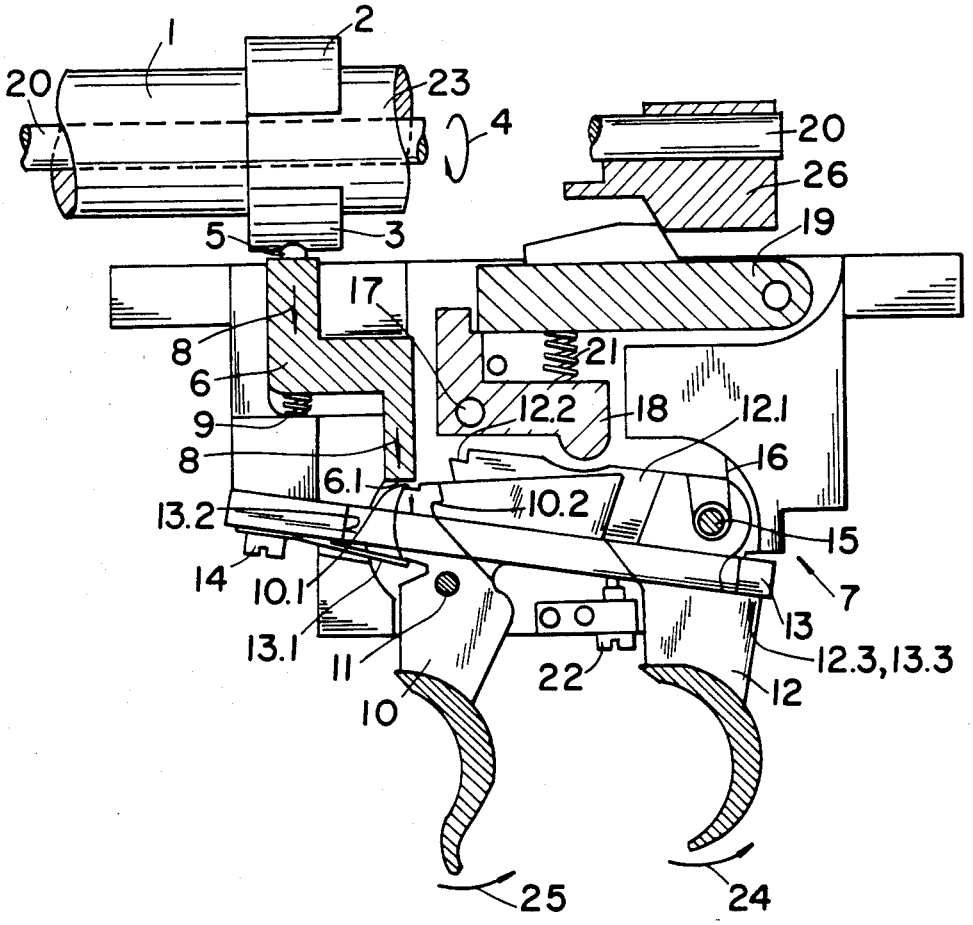
FIG. 2 is an elevational view, partly in section, of the trigger and reset mechanism of FIG. 1

Trigger 12 is pivotable about pin 15 and is inserted by means of a flanged sleeve 29 in a bore of housing 7. Housing 7 is closable with a cover plate 30. An upper portion 12.1 of trigger 12 as well as an upper portion of trigger 10 which carries shoulder 10.2 and edge 10.1, extend through slot 13.2 of spring 13 and lie above spring 13 as shown in FIG. 2. Trigger 12 includes a shoulder 12.3 at the rear end thereof on which a lower edge 13.3 of spring 13 rests.

The gun is cocked by tensioning spring 13. This is done by pulling trigger 12 rearwardly in the direction of arrow 24. This raises shoulder 12.3 which raises the right hand end of spring 13 as best shown in FIG. 2. The left hand end of spring 13 is held fast to housing 7 by screw 14.

The tongue 12.2 at the left hand end of trigger 12 moves downwardly and engages under the shoulder 10.2 of trigger 10. In this way spring 13 is held under tension and triggers 12 and 10 are engaged with each other. In this position (not shown) the upper edges of triggers 12 and 13 which are shown at an angle to each other in FIG. 2, actually extend substantially parallel to each other.

Upon a slight pull on trigger 10 in the direction of arrow 25, trigger 10 is disengaged from set trigger 12. The upper part or tongue 12.1 of trigger 12, under the action of spring 13, then strikes sear lever 18. Sear 19 then tilts downwardly since it has been released from sear lever 18. Sear 19 then releases nut 26 and firing pin 20. The pressure spring 21 is not sufficient to overcome the forward (leftward) movement of nut 26 and firing pin 20 which are under the stronger bias of spring 31.

It is noted that spring 13.1 which is also held by screw 14 just below spring 13, engages trigger 10 to prevent it from swinging loosely back and forth. Spring 13.1 holds trigger 13 by a slight bias in a direction opposite to arrow 25. Set screw 22 is provided to adjust the depth of mutual engagement between the triggers 10 and 12. Set screw 22 thus limits the distance to which trigger 12 can be pivoted or pulled in the direction of arrow 24.

To effect a release of hair trigger 12 in order to fire a shot, a slight actuation of trigger 10 in the direction of arrow 25 is sufficient. Hair trigger 12 is thereby disengaged from trigger 10. Due to the released force of hair trigger arm 13, hair trigger 12 is pivoted clockwise about pivot pin 15 against the direction of arrow 24 and strikes against sear lever 18. Sear lever 18 is thereby pivoted counterclockwise about its axis 17, so that sear 19 is disengaged for pivoting downwardly and releasing both firing pin nut 26 and firing pin 20.

To be able to reset hair trigger 12 safely, i.e. without causing a discharge, the reset member 6 is provided in trigger housing 7. An opening of locking head 23 causes latching of firing pin nut 26 in a rest notch through a cam. Firing pin nut 26 is thereby lifted from sear 19, so that the thrust of the firing pin spring is removed from the sear. A soon as locking head 23 is sufficiently open to disengage firing pin nut 26 from sear 19, further turning of bolt 1, which is connected to locking head 23, causes locking projection 3 to push reset member 6 downwardly against trigger 10, through edges 6.1 and 10.1. Trigger 10 is thereby pivoted about its axis 11 in the direction of arrow 25 whereby hair trigger 12 is disengaged from trigger 10 and executes a pivotal motion against the direction of arrow 24.

Thus, in accordance with the invention, there is provided in a firearm, particularly a sporting gun, of the type having a rotatable locking head with a rotatable bolt, and a trigger mechanism which is accommodated in a trigger housing, including a first trigger pivotally mounted to the housing and means for mechanically releasing the first trigger, and a hair trigger mounted in the trigger housing for movement from a safety position into a cocking position responsive to the pivotal movement of the first trigger, the combination comprising a locking head mounted on the bolt for rotation therewith, a reset member in the trigger housing performing a linear motion, the locking head being connected to the reset member during the rotary motion of the bolt in a manner such that the linear motion of the reset member is released in one direction, and with the first trigger being mounted on the axis for moving the reset member in said direction, thereby releasing the hair trigger.

The inventive arrangement is preferably characterized in that the reset member comprises an angled part which is inserted in the trigger housing for displacement. The angled reset member is preferably provided with a pressure pin which is operatively connected to the locking head, and within a spring bearing against the reset member whereby the reset member is pushed in a direction opposite to the direction of motion, so that the pressure pin remains in contact with the locking head. The reset member preferably couples the first trigger at a point ahead of the pivotal axis of the first trigger.

While a specific embodiment of the invention has been shown and described in detail to illustrate the application of the principles of the invention, it will be understood that the invention may be embodied otherwise without departing from such principles.

What is claimed is:

1. In a firearm, particularly a sporting gun of the type having a rotatable bolt and a trigger mechanism accomodated in a trigger housing, a first trigger pivotally mounted to the housing, a hair trigger engaged with said first trigger in a cocked position of the trigger mechanism, and means for mechanically releasing the first trigger from engagement with the hair trigger, the combination comprising:

a locking projection on the bolt;

a reset member mounted in the trigger housing for linear motion;

said locking projection being engagable with said reset member during the rotary motion of the bolt to actuate the linear motion of the reset member in one direction; and the first trigger being pivotally mounted on a pivot axis for pivoting movement responsive to the motion of the reset member in said one direction, thereby releasing the hair trigger from engagement with the first trigger.

2. The combination according to claim 1, wherein the reset member comprises an angle-shaped part mounted in the trigger housing for displacement.

3. The combination according to claim 2, wherein the angle-shaped reset member includes a pressure pin engageable with said locking projection and a spring bearing against the reset member for pushing the reset member in a direction opposite to said one direction of motion, so that said pressure pin remains in contact with said locking projection.

4. The combination according to claim 1, wherein said reset member engages the first trigger at a point ahead of the pivot axis of the first trigger.

* * * * *